US005507242A

United States Patent [19]

LeBlanc et al.

[11] Patent Number: 5,507,242

[45] Date of Patent: Apr. 16, 1996

[54] HAND OPERATED TROLLING MOTOR CONTROL STATION

[76] Inventors: Brad J. LeBlanc, Star Rte. 2 Box 183, Silsbee, Tex. 77656; Garry R. LeBlanc, P.O. Box 8713, Lumberton, Tex. 77657

[21] Appl. No.: 401,806

[22] Filed: Mar. 10, 1995

[51] Int. Cl.[6] ..... B63H 25/00

[52] U.S. Cl. ..... 114/144 R; 440/6

[58] Field of Search ..... 440/6, 7, 62, 53, 440/900; 74/480 B, 471 R, 491–493, 501.6; 114/144 R

[56] References Cited

U.S. PATENT DOCUMENTS

| | | | |
|---|---|---|---|
| 2,402,724 | 6/1946 | Bidwell | 114/144 R |
| 2,495,536 | 1/1950 | Morse | 114/144 R |
| 3,085,447 | 4/1963 | Shay | 114/144 R |
| 3,386,308 | 6/1968 | Butler | 74/480 B |
| 3,602,181 | 8/1971 | Harris | 114/153 |
| 3,861,348 | 1/1975 | Beierle | 440/6 |
| 3,940,674 | 2/1976 | Gill | 114/144 R |
| 4,358,189 | 11/1982 | Nylander | 354/293 |
| 4,604,066 | 8/1986 | Davatz | 440/7 |
| 4,698,032 | 10/1987 | Hill | 440/6 |
| 4,962,717 | 10/1990 | Tsumiyama | 114/144 R |
| 5,052,325 | 10/1991 | Rhines | 114/363 |

FOREIGN PATENT DOCUMENTS

| | | | |
|---|---|---|---|
| 2687364 | 8/1993 | France | 440/62 |
| 62-289499 | 12/1987 | Japan . | |

*Primary Examiner*—Edwin L. Swinehart
*Attorney, Agent, or Firm*—Richard C. Litman

[57] ABSTRACT

A hand operated remote control station for marine trolling motors. The hand operated remote control station enhances or replaces existing remote foot control stations for trolling motors. The remote hand control station is a totally adjustable, noncorrosive, telescoping steering shaft on which are placed the electric controls to remotely operate a trolling motor, such as power switches and speed control devices.

15 Claims, 2 Drawing Sheets

HAND OPERATED TROLLING MOTOR CONTROL STATION

BACKGROUND OF THE INVENTION

1. Field of the Invention

The present invention relates to trolling motor controllers used to control small electric propulsion units on recreational fishing boats when engaged in fishing activities.

2. Description of the Prior Art

Many small recreational fishing vessels are equipped with electric trolling motors which are used to maneuver the vessel when fishing at a desired location. Such motors have the advantages of running for extended periods of time on little energy and with minor disturbance of the water surrounding the vessel.

It is desirable to be able to comfortably control these trolling motors from the station from which the fisherman engages in fishing activities. The prior art shows control arms extending from the head of the motor and also remote control units which are foot controlled. For instance, U.S. Pat. No. 3,602,181, issued Aug., 1971 to G. H. Harris shows a foot operated remote controller for a trolling motor.

U.S. Pat. No. 3,861,348, issued Jan. 21, 1975 to J. C. Beierle shows a control arm directly attached to a trolling motor.

U.S. Pat. No. 4,604,066, issued Aug. 5, 1986 to C. R. Davatz shows a mechanical hand control assembly meant to be attached to a specific foot control pedal.

U.S. Pat. No. 4,698,032, issued Oct. 6, 1987 to D. A. Hill shows a telescoping control arm directly attached to a trolling motor.

U.S. Pat. No. 5,052,325, issued Oct. 1, 1991 to M. Rhines shows a chair mounted controller for a trolling motor.

Japanese Pat. No. 62-289499, issued Dec. 16, 1987 to T. Hosoya shows a trolling motor with a control handle.

None of the above inventions and patents, taken either singly or in combination, is seen to describe the instant invention as claimed.

SUMMARY OF THE INVENTION

It is desirable when fishing to have continual access to the trolling motor controller at the station from which one fishes. It is important that the controller not interfere with the operator's balance in the boat nor interfere with the fishing apparatus. As discussed above controllers with arms which attach directly to the motor have been developed. However, these type of devices require that the fisherman maintain a close proximity to the motor mount. These devices also require the arm to be horizontally rotated to steer the motor. This rotation can cause the control arm to be in an inaccessible or inconvenient position at times. Also developed to overcome some of these disadvantages are remote control devices which are operated by the operator's foot. These foot controllers also have disadvantages in certain boats and conditions. These controllers require that an operator control the vessel with a foot which precludes maintaining a solid stance in the vessel usually at times when sure footing is most needed, such as when accelerating or turning the vessel.

The present invention is a hand control station which allows the operator to maintain a solid stance in the vessel while controlling a trolling motor. The hand control station includes a telescoping shaft connected at one end to a base through an adjustable cog clamp. At the other end is a hand grip including a speed control knob and a power switch. The shaft is connected to the motor's steering cable through the base so one may steer the vessel by pushing or pulling on the shaft. This configuration allows the base to be located anywhere on the vessel and allows the handgrip to be conveniently positioned anywhere around the base for continual access. This arrangement allows an operator to have both feet firmly planted on deck and may also help maintain the operator's balance, as the controller is grasped in the hand when used to remotely control the operation of a trolling motor. These characteristics sharply reduce the chance of the operator being thrown overboard.

Accordingly, it is a principal object of the present invention to provide a convenient remote hand control station for electric trolling motors.

It is another object of the invention to provide a remote hand control station that will assist and will not interfere with an operators balance.

It is a further object of the invention to provide a remote hand control station that is totally adjustable such that it may be located at any convenient location around the operator.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
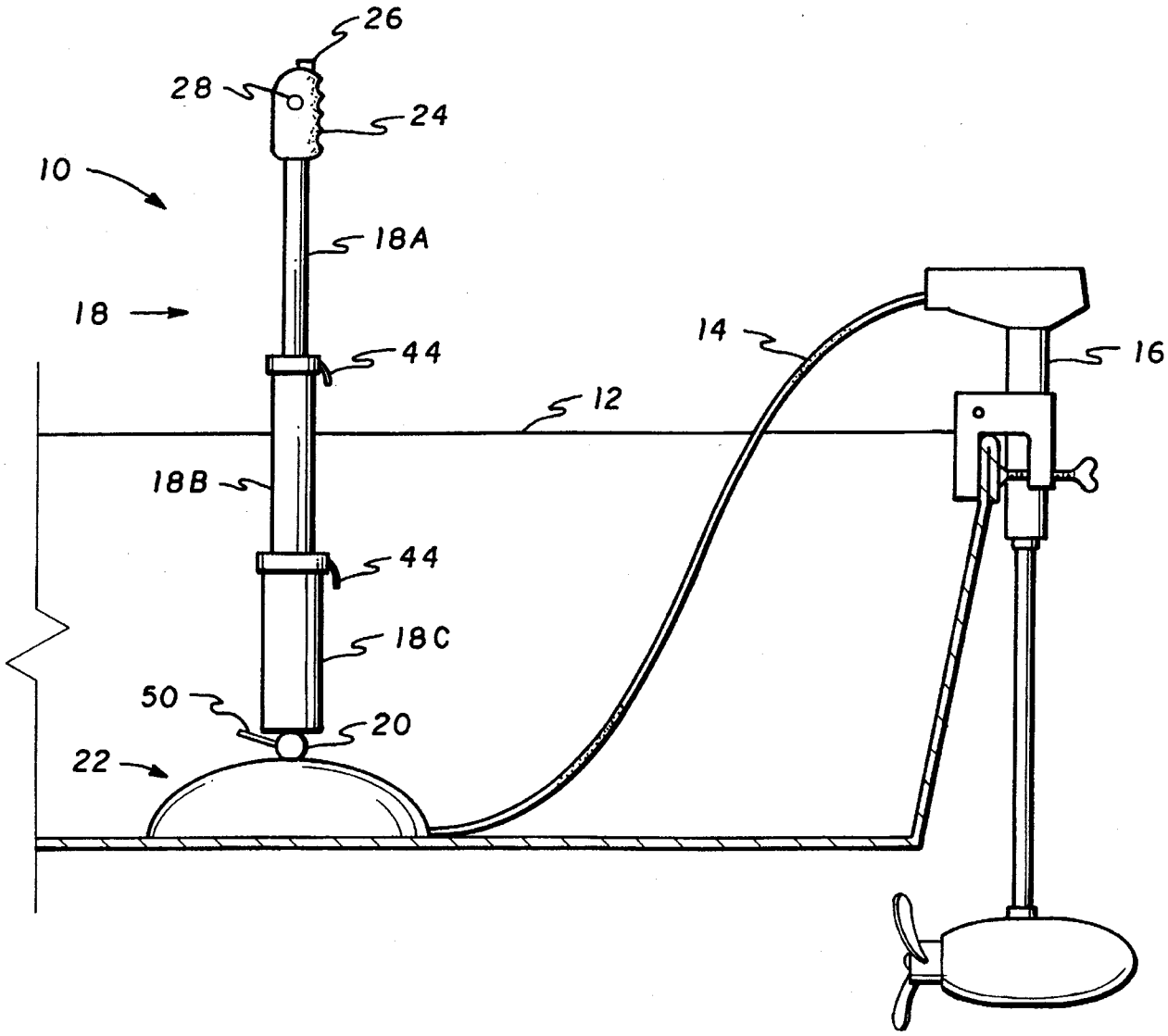
FIG. 1 as an elevational view of the hand control station and a trolling motor in a portion of a boat.
Figure 3:
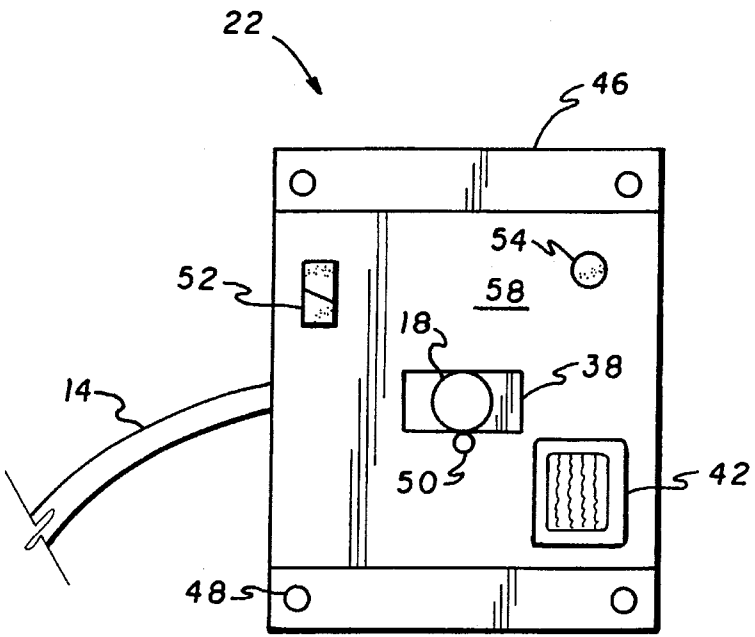
FIG. 3 is top view of the hand control station of the present invention.

The hand control station 10 of the present invention is shown in boat 12 in FIG. 1. Controller 10 is connected to umbilical cord 14 which is in turn connected to electric marine trolling motor 16. Controller 10 is comprised of telescoping shaft 18 which is connected to water repellent base 22. Base 22, as shown in FIG. 3, includes removable base plate 46 which secures controller 10 to boat 12 through bolt holes 48. At the end of shaft 18 distal from the connection to base 22 is an ergonomic hand grip 24. Included in hand grip 24 is power switch 26 and a rheostat including a speed control knob 28 which protrudes from the hand grip 24. The rheostat controls the speed of motor 16.

Figure 2:
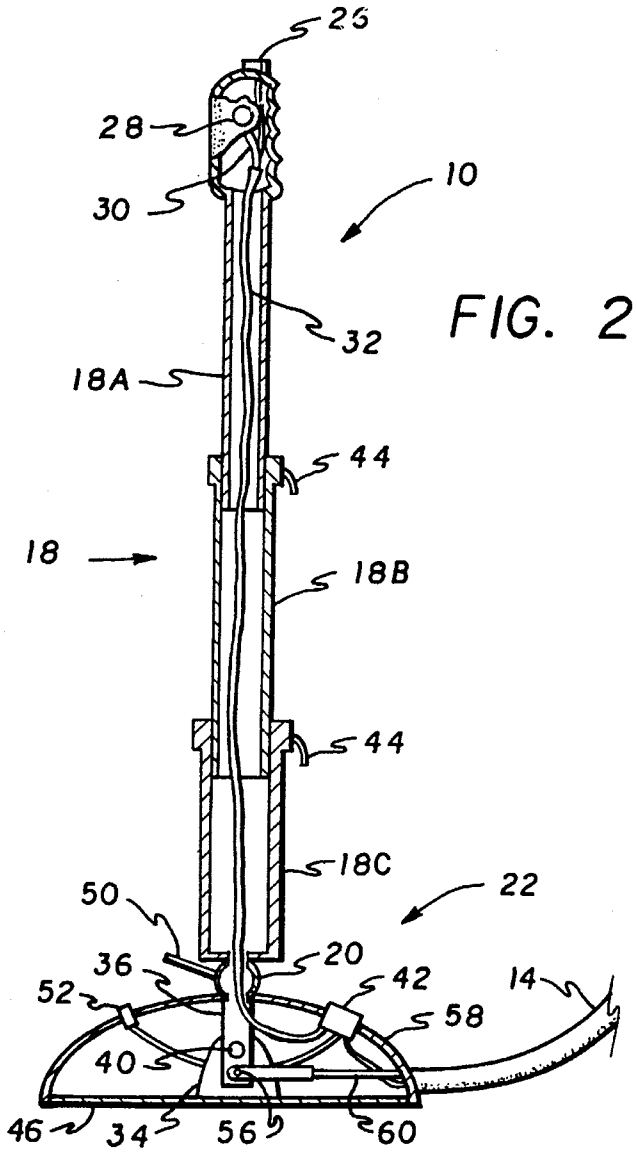
FIG. 2 is a section of the hand control station of the present invention.

As shown in FIG. 2, insulated control wires 30 from power switch 26 and from the rheostat are captured in flexible conduit 32 and run to the electric control system of motor 16 through shaft 18, base 22, and umbilical cord 14. In the preferred embodiment there are five small wires, two which connect to power switch 26 and three which connect to the rheostat. These wires are of such a small size that flexible conduit 32 does not interfere with the operation shaft 18.

Shaft 18 is comprised from a plurality of hollow sections shown as 18*a*, 18*b*, and 18*c* in FIG. 1. Section 18*a* is the smallest section and forms the upper end of the shaft 18 and fits into larger section 18*b* which itself fits into a successively larger section. Sections in the preferred embodiment are formed from aluminum.

At the top of each section, except the top section 18*a*, are clamp locks 44. Clamp locks 44 are commonly known quick type locks which use levers to selectively tighten the top of a shaft section around a captured smaller section thus selectively preventing the relative movement of adjacent sections. Clamp locks 44 are formed from non-corrosive material such as plastic.

The lower end of shaft 18 distal from hand grip 24 is formed from connection element 36 and passes through the housing 58 of base unit 22 at seal 38, as shown in FIG. 3. Connection element 36 is attached to the bottom section 18*c* through cog clamp 20. Cog clamp 20 is formed from two serrated plates that when tightened together with handle 50 will hold the upper portion of shaft 18 at any desired angle relative to base 22. Cog clamp 20 also allows shaft 18 to be stowed horizontally. The telescoping action allows the length of shaft 18 to be adjusted. This arrangement provides for the placement of hand grip 24 such that the steering, speed, and power controls of motor 16 will be maintained at the operator's finger tips.

Connection element 36 is connected to base 22 at an upper connection point at pivot pin 40. Connection element 36 is connected to spline 34 contained in base 22 through pivot pin 40. Below the upper connection point is lower connection point 56 connected to steering cable 60. An actuator Bowden cable connects lower connection point 56 of connection element 36 to a commonly known steering mechanism such as a rack and pinion mechanism in motor 16. This arrangement provides for remote steering of motor 16. When hand grip 24 is pushed forward shaft 18 is rotated around pivot pin 40 and pushes steering cable 60 which in turn actuates the steering mechanism of motor 16 to turn motor 16 to the right. In reverse, the angular motion of shaft 18 rotating around pivot pin 40 when hand grip 24 is pulled back causes steering cable 60 to be pulled thus turning motor 16 to the left. Included on pivot pin 40 is a friction control mechanism, such as nut fitted on a threaded portion of pivot pin 40. The friction control mechanism controls the force required to rotate shaft 18 around pivot pin 40. Thus when the friction control mechanism is tightened the force required to move hand grip 24 when steering boat 12 is increased.

Also included in base 22 are electric controls for motor 16, including foot controlled rheostat 42 for controlling the speed of motor 16, power switch 54, and voltage selector switch 52 for selecting between 12 and 24 volt operation of motor 16.

It is contemplated that a device of the present invention may be installed so as to enhance existing foot operated trolling motor controllers. A telescoping shaft 18 as described above including cog clamp 20, control wires 30, and hand grip 24 with power switch 26, and the rheostat including speed control knob 28 would be attached at the upper connection point of connection element 36 to the spline 34 of an existing controller through pivot pin 40 in place of an existing foot pedal. The lower connection point 56 would be connected to steering cable 42. Control wires 30 would be attached through quick electrical connectors to the wiring from the electrical controls 42, 52, and 54 for motor 16 in base 22.

It is to be understood that the present invention is not limited to the sole embodiment described above, but encompasses any and all embodiments within the scope of the following claims.

We claim:

1. A remote hand control station for an electric trolling motor comprising:

a shaft including a first end and a second end;

an electric speed control device located on said shaft;

conversion means for translating angular motion of said shaft to linear motion of a steering cable connected to a steering system of the trolling motor; and a base including a power switch and a foot controlled electric speed control device, said base containing said conversion means.

2. The remote hand control station according to claim 1, wherein said electric speed control device includes a rheostat electrically connected to an electric control system of the trolling motor.

3. The remote hand control station according to claim 1, wherein said shaft is comprised of a plurality of telescoping sections whereby the height of said shaft is adjustable.

4. The remote hand control station according to claim 1, further comprising:

an adjustment means for selectively altering and maintaining an angle between said shaft and said base.

5. The remote hand control station according to claim 4, wherein said shaft is comprised of a plurality of telescoping sections whereby said second end of said shaft is adjustable to any convenient position for a user of the control station.

6. The remote hand control station according to claim 5, wherein said adjustment means includes a cog clamp.

7. The remote hand control station according to claim 5, wherein a plurality of said telescoping sections further comprise clamp locks which selectively maintain the relative positions of said telescoping sections thereby maintaining the height of said shaft.

8. The remote hand control station according to claim 5, further comprising a power switch contained in said second end of said shaft and wherein said second end of said shaft also contains said speed control device.

9. The remote hand control station according to claim 8, further comprising a plurality of control wires connecting said speed control device and said power switch with an electric control system of the trolling motor, and wherein said control wires run from said speed control device and said power switch to said base through said telescopic sections of said shaft.

10. The remote hand control station according to claim 9, further comprising a flexible conduit housing said control wires.

11. The remote hand control station according to claim 10, wherein said conversion means includes means for selectively altering the force required to produce angular motion of said shaft.

12. The remote hand control station according to claim 11, wherein said base includes a removable base plate.

13. The remote hand control station according to claim 12, further comprising an umbilical cord connecting said base to the trolling motor, said umbilical cord containing said control wires and the steering cable.

14. A hand controller for an electric trolling motor remote control station comprising:

a shaft including an upper end and a lower end wherein said shaft is comprised from a plurality of telescoping sections, a connection element, and a cog clamp, wherein said plurality of telescoping sections includes at least a smallest section which forms the upper end of said shaft and a largest section and wherein said cog clamp connects said largest section to said connection element, an ergonomic hand grip attached to said upper end of said shaft, a power switch on said hand grip, a first rheostat contained in said hand grip including a control knob which extends from said hand grip, a plurality of control wires running from said power switch and said rheostat through said telescoping sections and terminating in quick electrical couplers whereby said connection element may be connected to a spline in a base of the remote control station and to a steering cable attached to the trolling motor such that angular motion of said shaft is translated to linear motion of the steering cable and said control wires may be connected to a trolling motor electrical control system through connection to a power switch and a second rheostat in the base unit with said quick electrical connectors such that said first rheostat may control the speed of the trolling motor.

15. An electric marine trolling propulsion assembly comprising:

an electric trolling motor;

a hand remote control station including, a shaft including an upper end and a lower end wherein said shaft is comprised from, a plurality of hollow telescoping sections including at least a smallest section which forms said upper end of said shaft, and a largest section, a connection element which forms said lower end of said shaft including, an upper connection point, and a lower connection point, and a cog clamp which connects said largest section with said connection element, an ergonomic hand grip attached to said upper end of said shaft, a first power switch on said hand grip, a first rheostat contained in said hand grip including a control knob which extends from said hand grip, a base comprising, a base plate including means for attachment to a boat, a housing removable attached to said base plate, said housing including an opening through which said shaft passes, a seal positioned in the opening, and a spline positioned below the opening, a second power switch on said base, a foot controlled rheostat on said base, a voltage selector switch on said base, a pivot pin including a friction control mechanism which attaches said spline to said upper connection point of said connection element;

an umbilical cord connecting said electric trolling motor with said hand remote control station;

a plurality of insulated electric control wires running through said shaft, said base unit, and said umbilical cord connecting said switches, said rheostats, and said voltage selector switch to said electric trolling motor; and a steering cable passing through said umbilical cord connecting said lower connection point on said connection element to said electric trolling motor.

* * * * *